US006588305B2

(12) United States Patent
Giannakakos et al.

(10) Patent No.: US 6,588,305 B2
(45) **Date of Patent: *Jul. 8, 2003**

(54) NOTCH-FORMING EXTRACTION TOOL FOR HELICAL INSERTS

(75) Inventors: William Giannakakos, Danbury, CT (US); Roger L. Zitnay, Easton, CT (US)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/853,120

(22) Filed: May 10, 2001

(65) Prior Publication Data

US 2002/0166420 A1 Nov. 14, 2002

(51) Int. Cl.[7] ..... B25B 23/08
(52) U.S. Cl. ..... 81/441; 81/443
(58) Field of Search ..... 81/441, 443, 445, 81/440, 442, 444; 29/240.5, 227

(56) References Cited

U.S. PATENT DOCUMENTS

| | | | | | |
|---|---|---|---|---|---|
| 1,741,349 | A | * | 12/1929 | Sullivan | 81/441 |
| 2,244,824 | A | * | 6/1941 | Caminez | 81/441 |
| 2,390,545 | A | | 12/1945 | Lang | |
| 2,586,805 | A | | 2/1952 | Forster | |
| 2,594,901 | A | | 4/1952 | Forster | |
| 3,111,751 | A | | 11/1963 | Eddy | |
| 3,148,566 | A | * | 9/1964 | Reetz | 81/441 |
| 4,026,338 | A | * | 5/1977 | Goebel | 81/441 |
| 4,172,314 | A | | 10/1979 | Berecz et al. | |
| 4,553,302 | A | | 11/1985 | Cosenza et al. | |
| 4,553,303 | A | | 11/1985 | Yamamoto | |
| 4,980,959 | A | | 1/1991 | Czarnowski | |
| 5,214,831 | A | | 6/1993 | Collins, Jr. et al. | |
| 5,309,617 | A | | 5/1994 | Dannar | |
| 5,456,145 | A | | 10/1995 | Cosenza | |
| 6,152,000 | A | * | 11/2000 | Mowins | 81/441 |

* cited by examiner

*Primary Examiner*—Joseph J. Hail, III
*Assistant Examiner*—Hadi Shakeri
(74) *Attorney, Agent, or Firm*—Harness, Dickey & Pierce, P.L.C.

(57) ABSTRACT

A notch-forming extraction tool for helically coiled wire inserts according to the invention includes a mandrel with a second end having a tooth adapted to form and be received by a notch of the insert. A first end opposite the second end is received in a bushing of a handle portion for connecting the mandrel to the handle. Left-hand rotation of the handle contracts the insert about the second end of the mandrel to facilitate removal of the insert.

44 Claims, 7 Drawing Sheets

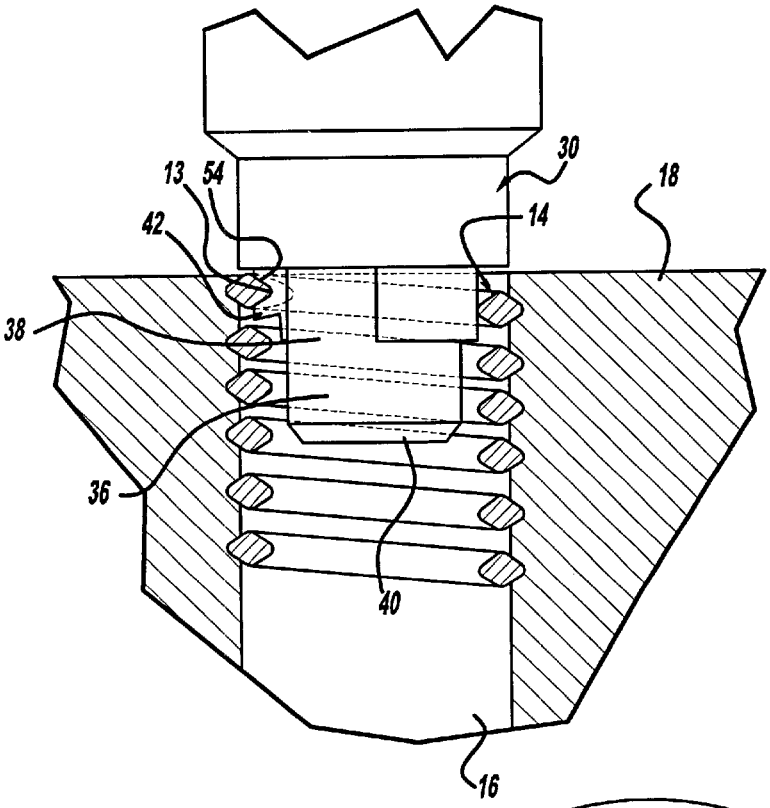
Figure - 7
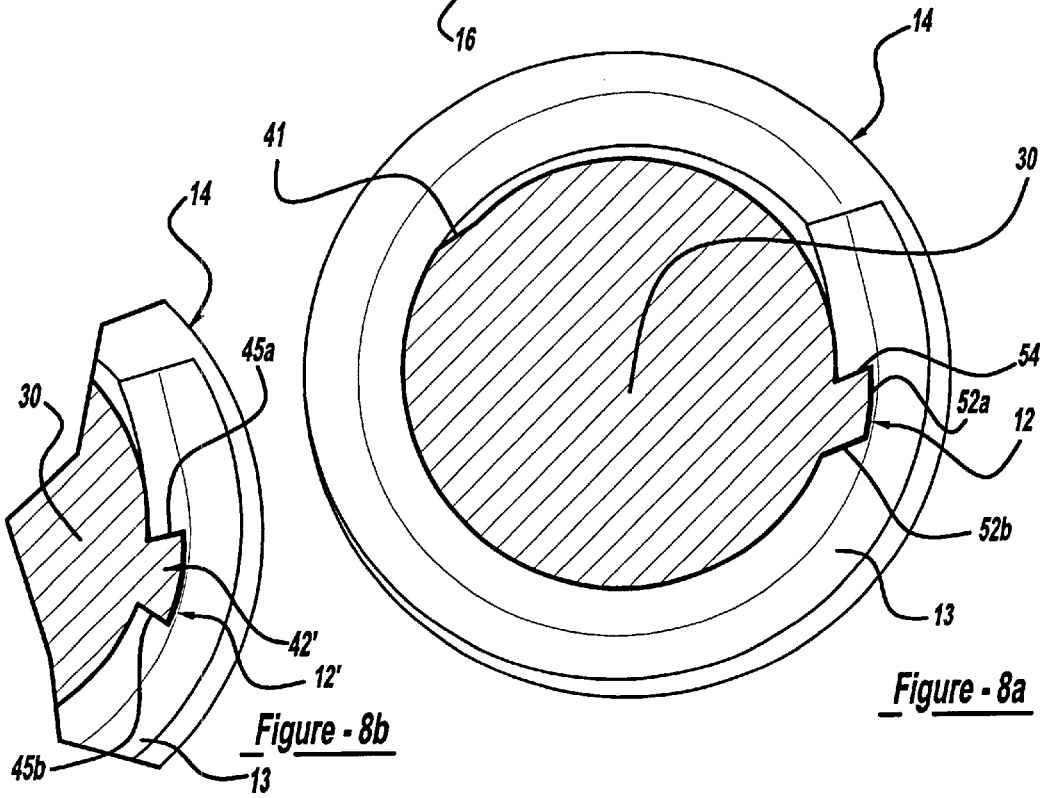
Figure - 8a
Figure - 8b

NOTCH-FORMING EXTRACTION TOOL FOR HELICAL INSERTS

BACKGROUND OF THE INVENTION

The invention relates to a tool for helically coiled wire inserts and, more particularly, to a notch-forming extraction tool for use in association with helically coiled inserts.

Tools for the removal of helically coiled wire inserts are well known. Generally, these tools have a tapered blade with a pair of knife edges that are driven into the inner diameter threads of the insert. Such as tool is described in U.S. Pat. No. 6,171,040. When using these tools to extract an insert, however, the insert and the parent material surrounding it is often permanently damaged.

Another type of removal tool for helically coiled wire inserts is described in U.S. Pat. No. 4,553,303 and includes a mandrel having a threaded lead portion and a pivotable pawl inserted in a groove below the threaded portion so that the pawl can engage a notch in the trailing end of the insert in order to extract the insert from the tapped hole. This pivotable pawl automatically engages the insert when the mandrel is pulled back, allowing the mandrel to extract the insert. Although this known extraction tool does not damage the parent material of the insert, it is a relatively complicated design and suffers from increased risks of malfunction. Further, because each insert requires a tool of complimentary size, a set of tools taught by the aforementioned patent is relatively expensive.

An improved extraction and adjustment tool for helically coiled wire inserts is described in co-pending U.S. patent application Ser. No. 09/596,035, which is incorporated herein by reference. While the extraction and adjustment tool described therein is believed to be a significant advancement over the prior art, it is particularly suited for use with inserts already having a notched coil end.

SUMMARY OF THE INVENTION

An extraction tool for helically coiled wire inserts includes a mandrel with a threadless lead portion having a stationary tooth for forming a notch in a trailing end of the insert. Upon formation of the notch, the extraction tool can thereafter be utilized for extracting the insert from a tapped hole. The extraction tool may include a handle portion having a bushing for selective reception of a mandrel adapted to fit a particular-size helically coiled wire insert or may be used in association with a power tool to effectuate removal of the insert. Once the extraction tool is inserted into the internal diameter of the insert and a notch is formed, the stationary tooth engages the notch in the trailing end of the insert to extract the wire insert.

DESCRIPTION OF THE DRAWINGS

FIG. 7 is a partial sectional view of the lead end of the notch-forming extraction tool as shown in FIG. 6 forming a notch in a helically coiled wire insert in a bore of a parent material;

FIG. 8*a* is a partially sectioned top view of the lead end of the notch-forming extraction tool as shown in FIG. 7 engaging the inner diameter of the helically coiled wire insert;

FIG. 8*b* is a partially sectioned top view of the lead end of the notch-forming extraction tool as shown in FIG. 5*b* engaging the inner diameter of the helically coiled wire insert;

DETAILED DESCRIPTION OF THE PREFERRED EMBODIMENT

Figure 1:
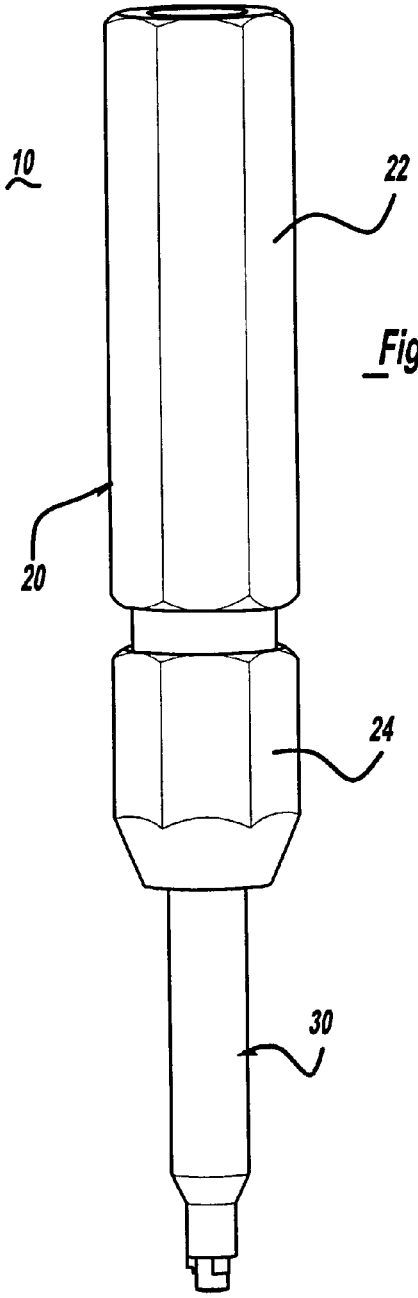
FIG. 1 is a front view of a notch-forming extraction tool for helical inserts according to the invention.
Figure 2:
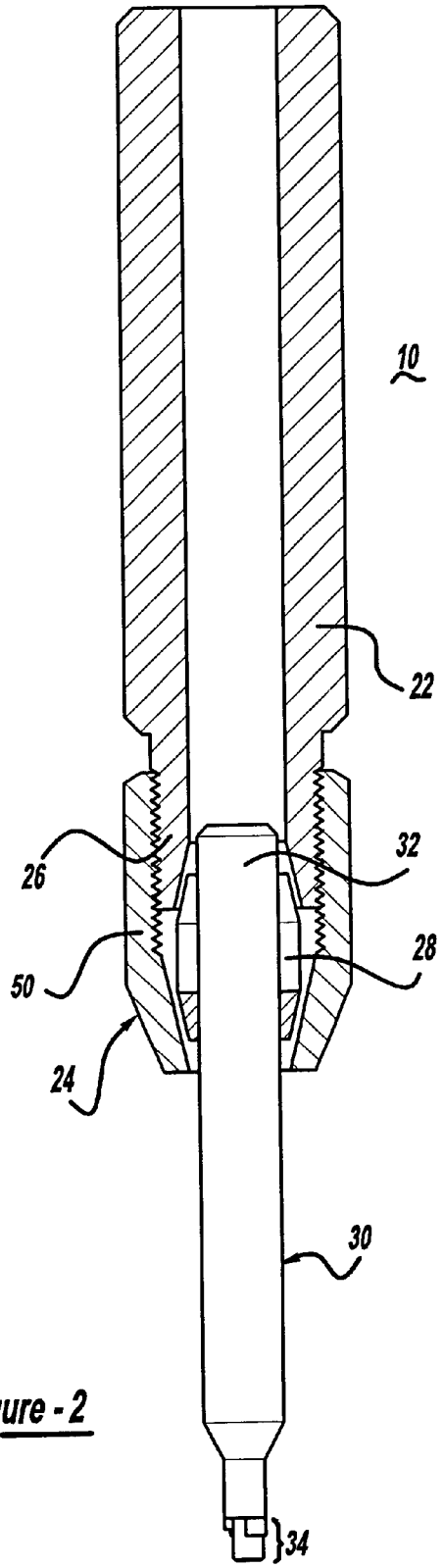
FIG. 2 is a partial sectional view of the notch-forming extraction tool of FIG. 1.

With reference to the drawings, and to FIGS. 1 and 2 in particular, an extraction tool 10 for use in association with helically coiled wire inserts is shown. Helical inserts are used, for example, where a steel fastener having conventional threads is desired to be fastened into a material of relatively softer alloy, such as aluminum. The helical inserts may be of either the tang, tangless or screw-lock type. Extraction tool 10 of the present invention may include a manually driven handle 22 at one end and a coupler 24 at an opposite end. Coupler 24 selectively receives a mandrel 30 of the extraction tool 10 and supports mandrel 30 in removing a helical insert 14 in tapped hole 16 of a parent material 18, as illustrated in FIGS. 6, 7, 9 and 13. Alternatively, the extraction tool 10 may be a bit or mandrel that is power driven by a motor, such as with a power drill or screw driver (not shown).

As shown in FIG. 2, the mandrel 30 includes a first end 32 for insertion into coupler 24, which selectively compresses a bushing 28 on first end 32. Coupler 24 includes a nut portion 50 having an internal screw thread for tightening on an external screw thread cut in end portion 26 of handle 22. When fully tightened on end portion 26, nut portion 50 of coupler 24 compresses bushing 28 against first end 32 of mandrel 30, thereby securing mandrel 30 to handle 22. Preferably, the diameter of mandrel 30 pilots on the inner diameter of tapped hole 16.

As best illustrated with reference to FIGS. 3 and 4, at an end opposite the first end 32, the mandrel 30 includes a second end 34, which has a leading portion 38 having a larger diameter portion 36 and a smaller diameter portion 37. Larger diameter portion 36 approximates an inner diameter of helical insert 14 when insert 14 is installed in tapped hole 16 and expanded against parent material 18. More specifically, larger diameter portion 36 is slightly smaller than the inner diameter of insert 14 in its installed state, thereby facilitating axial insertion of leading portion 38 into an installed insert 14. Larger diameter portion 36 partially extends about the circumference of the leading portion 38. Specifically, larger diameter portion 36 extends about three quarters of the circumference of the leading portion 38 and includes an inclined surface 41 at one end and a tooth 42 at an opposite end. A void 39 between inclined surface 41 and tooth 42 exposes smaller diameter portion 37. Finally, a ramped leading edge 40 of the second end 34 caps smaller diameter portion 37 and facilitates insertion of mandrel 30 into insert 14.

Figure 3:
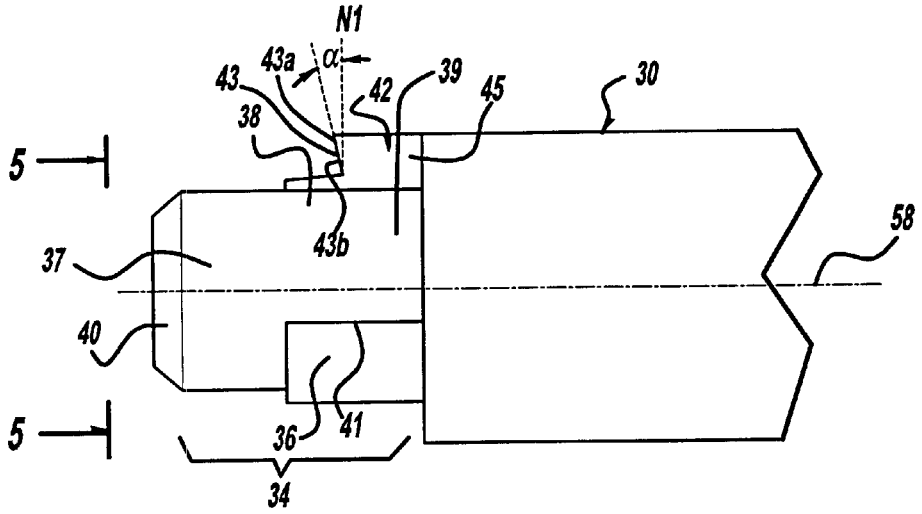
FIG. 3 is a partial side view of a lead end of the notch-forming extraction tool of FIG. 1.
Figure 4:
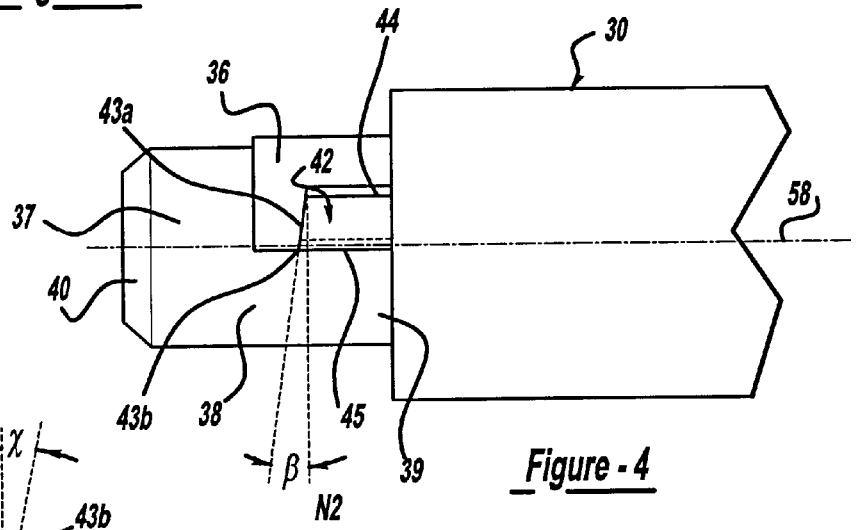
FIG. 4 is a partial top view of the lead end of the notch-forming extraction and adjustment tool of FIG. 1.
Figure 5A:
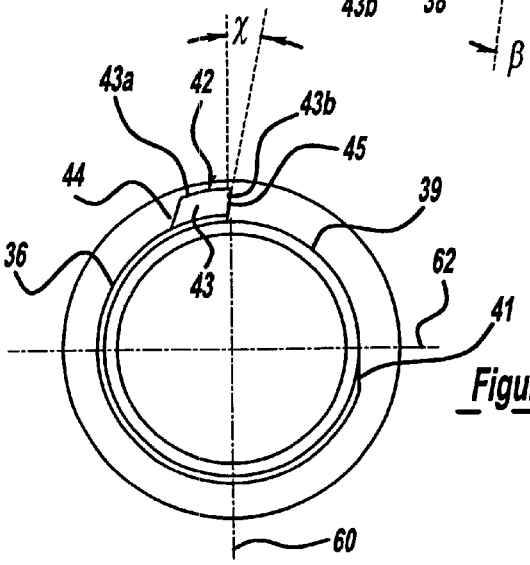
FIG. 5*a* is an end view of the lead end of the notch-forming extraction tool of FIG. 1.

As shown in FIGS. 3, 4, 5*a* and 5*b*, a central longitudinal axis 58 extends through the axial center of the second end 34. As best shown in FIG. 5*a*, the central longitudinal axis 58 is defined by the intersection of a first longitudinal plane 60 and a second longitudinal plane 62. The axis and planes are illustrated for the explanation below.

Figure 9:
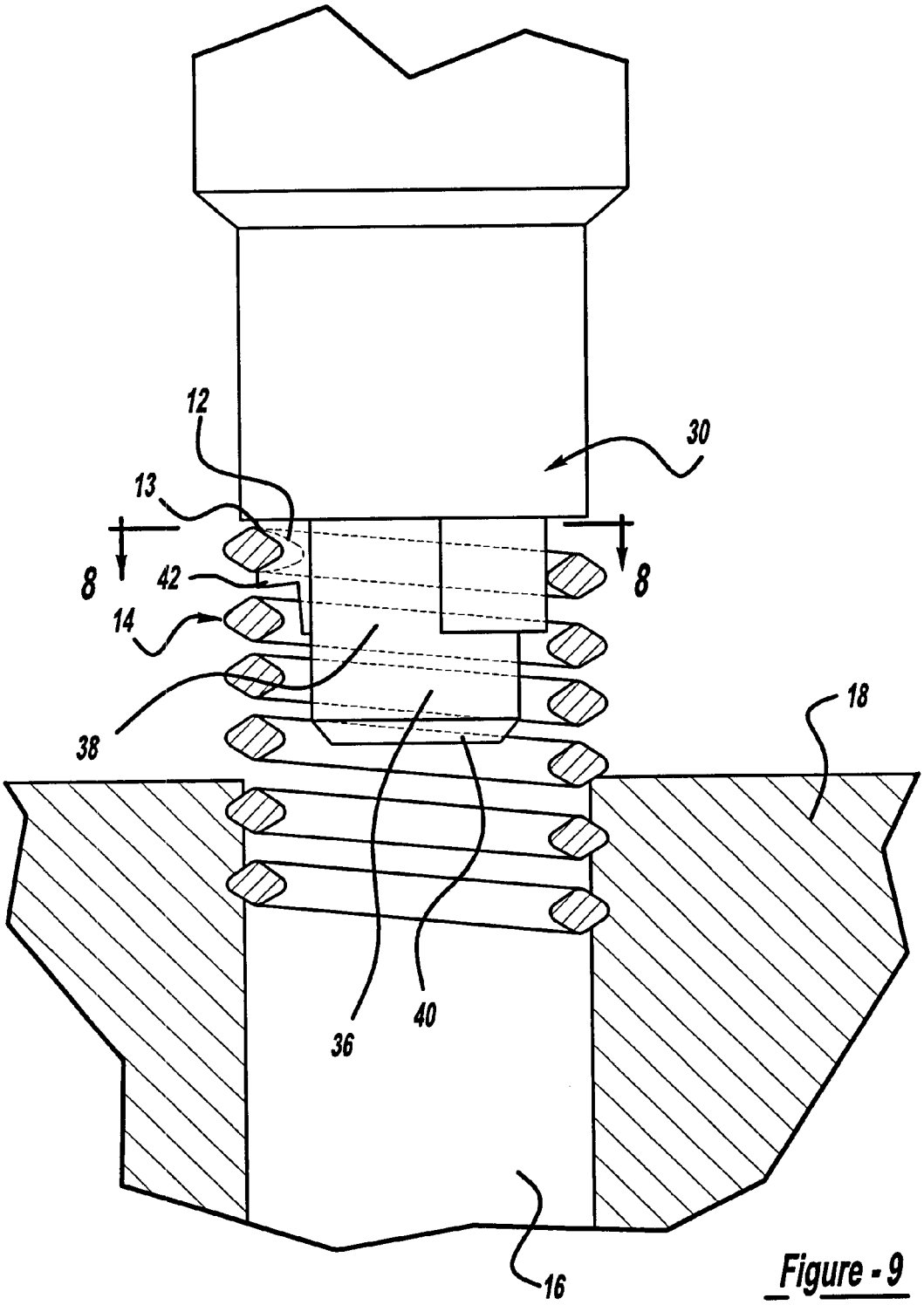
FIG. 9 is a partial sectional view of the lead end of the notch-forming extraction tool as shown in FIG. 8 removing a helically coiled wire insert from the bore of a parent material.

As shown in FIGS. 7–9, insert 14 includes a notch 12 on a trailing end 13. As shown best in FIG. 8, notch 12 includes a lead wall portion 54 and a pair of camming surfaces 52*a* and 52*b* for locating the tooth or pawl of an extraction tool. As described below, the extraction tool 10 according to the invention not only forms this notch 12, but also uses this notch 12 for removing helical insert 14.

To this end, as illustrated in FIG. 5*a*, the tooth 42 formed at one end of the larger diameter portion 36 is adapted to form and engage the notch 12 in trailing end 13 of helical insert 14. More specifically, tooth 42 includes a face 43, a ramp 44 and a shoulder 45.

As best shown in FIG. 3, face 43 angles outwardly toward ramped leading edge 40 at an angle $\alpha$, preferably approximately 3 degrees from normal N1, which is in a plane disposed perpendicularly to central longitudinal axis 58. An acceptable angle $\alpha$ according to the invention is preferably between 1 and 15 degrees. As shown in FIG. 4, face 43 also angles from ramp 44 to shoulder 45 at an angle $\beta$, preferably approximately between 3 and 5 degrees from normal N2, which is in a plane disposed perpendicularly to central longitudinal axis 58. An acceptable angle $\beta$ according to the invention is preferably between 1 and 15 degrees. As best shown in FIG. 5*a*, shoulder 45 angles from the first longitudinal plane 60 an at angle $\chi$, preferably approximately 12 degrees. An acceptable angle $\chi$ according to the invention is preferably between 5 and 15 degrees.

As shown in FIGS. 3–5*a*, a first cutting edge 43*a* is formed at the intersection of face 43 and the top of tooth 42 and a second cutting edge 43*b* is defined by the intersection of face 43 and shoulder 45. Cutting edges 43*a* and 43*b* define a compound angle capable of cutting a notch in an insert 14, as will be discussed below.

Figure 5B:
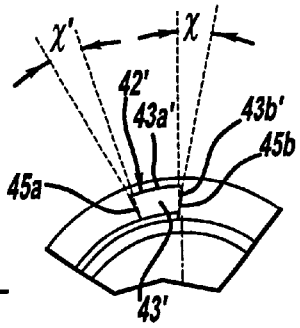
FIG. 5*b* is an end view of an alternative embodiment of the lead end of the notch-forming extraction tool according to the invention.

A variation of the invention is shown in FIG. 5*b*, wherein a tooth 42' is formed at one end of the larger diameter portion 36. Like tooth 42, tooth 42' is adapted to form and engage a notch in the trailing end 13 of helical insert 14. More specifically, tooth 42' includes shoulders 45*a*, 45*b* flanking a face 43'.

Like face 43 for tooth 42, as best shown in FIG. 3, face 43' angles outwardly toward ramp leading edge 40 at an angle $\alpha$, preferably approximately 3 degrees from normal N1, which is in a plane disposed perpendicularly to central longitudinal axis 58. An acceptable angle $\alpha$ according to the invention is preferably between 1 and 15 degrees. Also like face 43 of tooth 42, as shown in FIG. 4, face 43' angles from shoulder 45*a* to shoulder 45*b* at an angle $\beta$, preferably approximately between 3 and 5 degrees from normal N2, which is in a plane disposed perpendicularly to central longitudinal axis 58. An acceptable angle $\beta$ according to the invention is preferably between 1 and 15 degrees. As best shown in FIG. 5*b*, shoulders 45*a*, 45*b* angle approximately 12 degrees from a longitudinal plane such as the first longitudinal plane 60. An acceptable angle $\chi$, $\chi'$ according to the invention is preferably between 5 and 15 degrees.

Similar to the cutting edge illustrated for tooth 42 of FIGS. 3–5*a*, a first cutting edge 43*a*' is formed at the intersection of face 43' and the top of tooth 42' and a second cutting edge 43*b*' is defined by the intersection of face 43' and shoulder 45*b*. Cutting edges 43*a*' and 43*b*' define a compound angle capable of cutting a notch in an insert 14, as will be described below.

Figure 6:
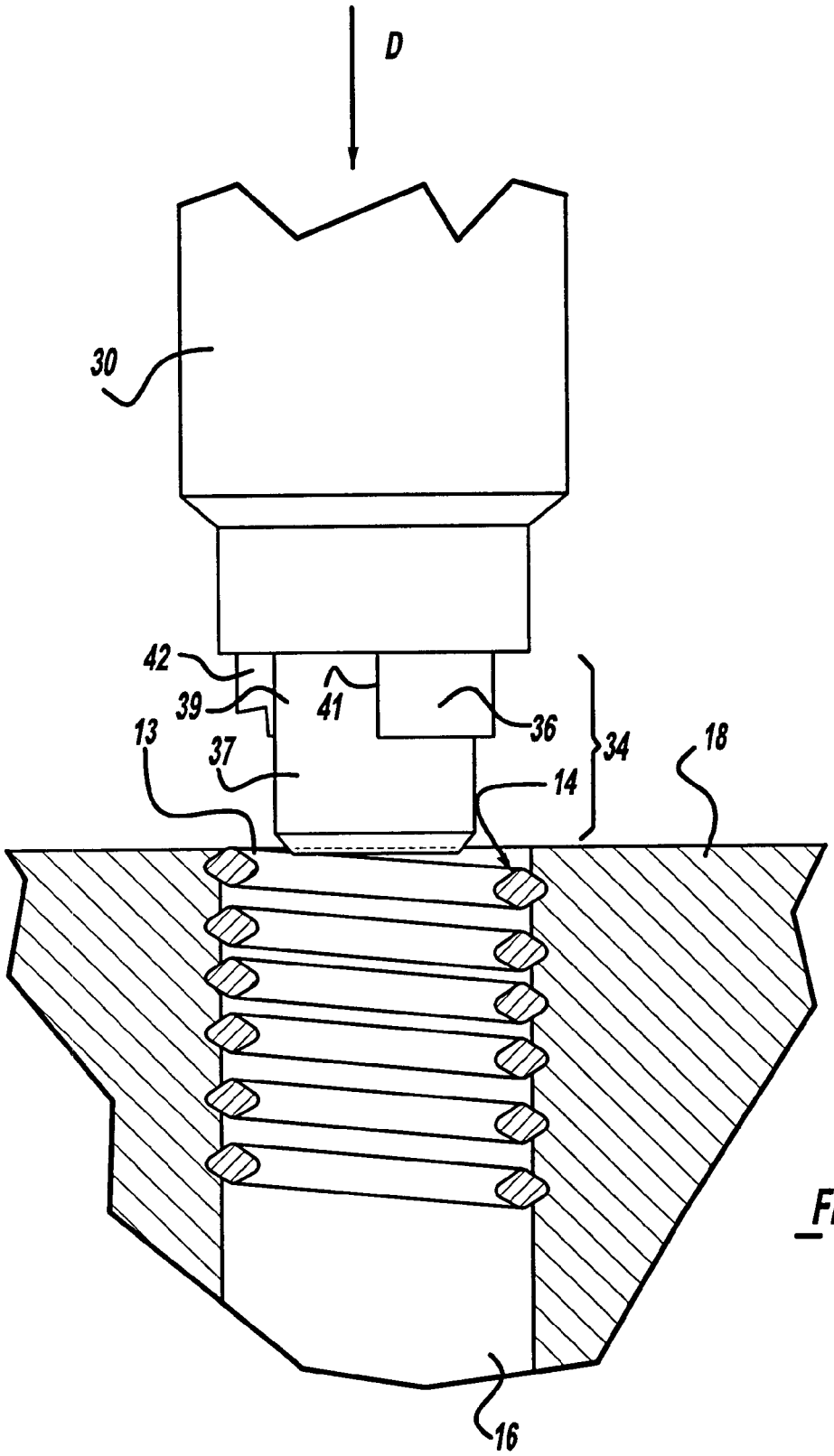
FIG. 6 is a partial sectional view of the lead end of the notch-forming extraction tool as shown in FIGS. 1–4, 5*a* and 5*b* prior to forming a notch in a helically coiled wire insert installed in a bore of a parent material.

To form the notch 12, ramped leading edge 40 of leading portion 38 is coaxially aligned with helical insert 14, as shown in FIG. 6. The second end 34 is inserted to the required depth in the tapped hole 16. An axial driving force, shown as arrow D in FIG. 6, is exerted on extraction tool 10 to force cutting edges 43*a* and 43*b* to strike a portion of trailing end 13 of insert 14. The downward driving force may be created manually, such as by striking a hammer against the tool 10, or through the use of a power tool (not shown), such as a pneumatically or electrically powered system.

As shown in FIG. 7, cutting edges 43*a* and 43*b* strike trailing edge 13 and shear material from trailing end 13 away to define notch 12 in a shape complimentary to tooth 42. The angled surfaces of face 43 and shoulder 45 are shaped to move the sheared material away from insert 14 such that the material can easily be removed.

Upon formation of notch 12, extraction tool 10 can be used to extract insert 14, as shown in FIGS. 8*a*, 8*b* and 9. The extraction of the insert can be performed while tooth 42 remains engaged with notch 12 following notch-forming procedures. Otherwise, if, for example, a worker wishes to disengage the tooth 42 from notch 12 so that the extraction tool 10 can be used for another task, the tooth 42 may be disengaged from notch 12 and re-engaged at a later time. The re-engagement of tooth 42 with notch 12 can be accomplished due to the shape of tooth 42. Specifically, ramp 44 of tooth 42 allows camming on surfaces 52*a* and 52*b* of newly formed notch 12 to facilitate location of the tooth 42 in the notch 12 of the insert 14.

In either case, when the tooth 42 is engaged with the notch 12, left-hand rotation of mandrel 30 contracts insert 14 about leading portion 38 of mandrel 30. More specifically, shoulder 45 strikes lead wall 54, forcing insert 14 to tighten about leading portion 38, whereby insert 14 is no longer expanded against parent material 18. Once contracted, continued left-hand driving force of mandrel 30 against insert 14 permits removal. To disengage tooth 42 from notch 12 following removal, slight right-hand rotation (approximately ¼ turn) of mandrel 30 will disengage tooth 42 from notch 12 by camming ramp 44 along surface 52*b*.

FIG. 8*b* illustrates the tooth 42', as discussed above, engaging an insert 14. More specifically, the tooth 42' engages a notch 12', which is formed similar to notch 12. That is, upon coaxially aligning the ramp leading edge 40 of leading portion 38 of extraction tool 10, and inserting the second end 34 to required depth in the tapped hole 16, an axial driving force is exerted on extraction tool 10 to force cutting edges 43*a*' and 43*b*' to strike a portion of trailing end 13 of insert 14. The cutting edges 43*a*' and 43*b*' share material from trailing end 13 away to define notch 12' in a shape complimentary to tooth 42'. The angled surfaces of face 43' and shoulders 45*a* and 45*b* are shaped to move the shared material away from the insert 14 such that the material can be easily removed. As before, extraction tool 10 can be used to extract insert 14 following notch formation. Also as before, when the tooth 42' is engaged with the notch 12', left-hand rotation of mandrel 30 contracts insert about leading portion 38 of mandrel 30. More specifically, shoulder 45*a* strikes lead wall 54, forcing insert 14 to tighten about leading portion 38, whereby insert 14 is no longer expanded against parent material 18. Once contracted, continued left-hand driving force of mandrel 30 against insert 14 permits removal. To disengage tooth 42' from notch 12' following removal, insert 14 must be slid axially from mandrel 30 until tooth 42 disengages the notch 12'.

Figure 11:
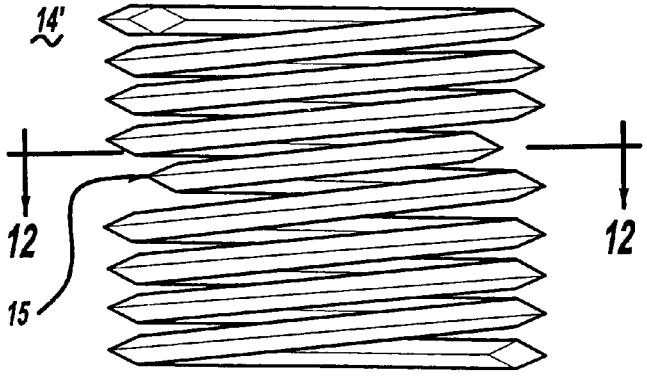
FIG. 11 is a side view of a screw-lock type insert for use with the notch-forming extraction tool of FIG. 1.
Figure 12:
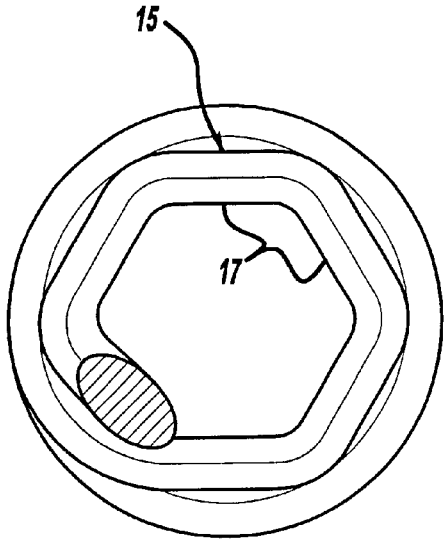
FIG. 12 is a sectional view of the screw-lock type insert along line 12—12 of FIG. 11.
Figure 13:
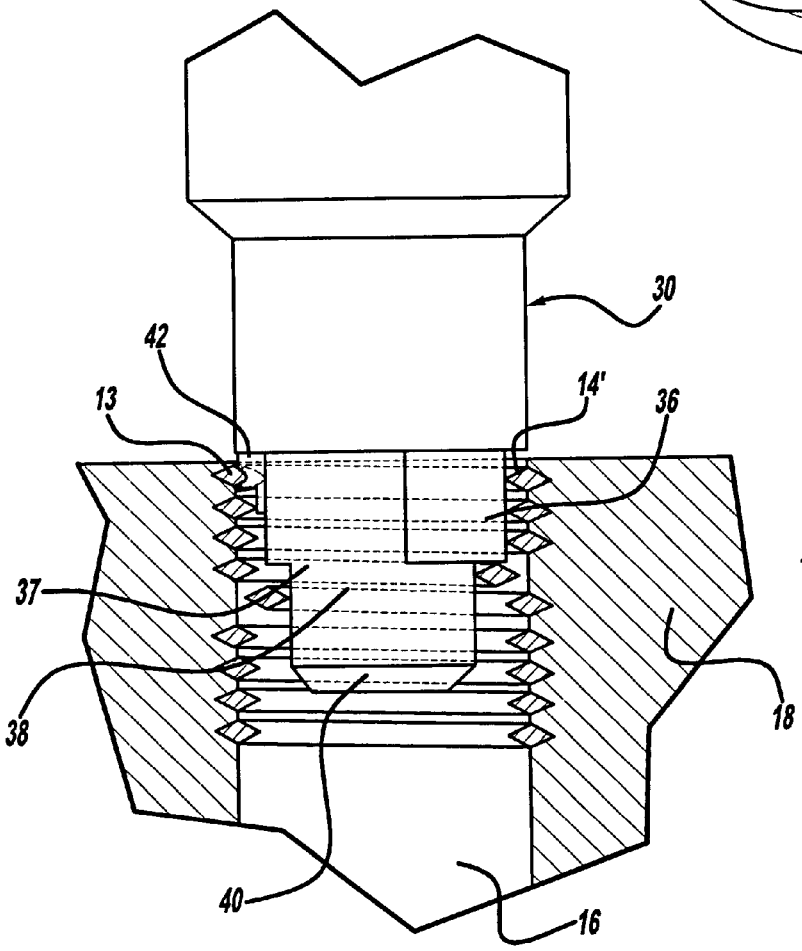
FIG. 13 is a partial sectional view of the lead end of the notch-forming extraction tool as shown in FIGS. 1–4, 5*a* and 5*b* engaging the inner diameter of the screw-lock type insert of FIGS. 11–12 in a bore of a parent material.

With reference to FIGS. 11–13, a screw-lock type insert 14' is illustrated. The insert 14' includes a reduced coil 15, preferably disposed intermediately among the series of coils of insert 14'. As shown best in FIG. 12, reduced coil 15 has a generally hexagonal inner diameter including mid-grip flats 17. The smaller diameter portion 37 of leading portion 38 is adapted to pilot on mid-grip flats 17 of the screw-lock type insert 14', as best shown in FIG. 13. The engagement of the smaller diameter portion 37 on mid-grip flats 17 of reduced coil 15 facilitates removal of screw-lock type insert 14'.

To use extraction tool 10, the user simply inserts second end 34 of mandrel 30 into an insert 14' installed in tapped hole 16 of parent material 18 until tooth 42 strikes the trailing end 13 of the insert 14' to cut a notch 12. This process is the same as that described with reference to insert 14 and, as such, will not be repeated here.

Upon formation of the notch 12, when tooth 42 is engaged with notch 12, tooth 42 is positioned to remove insert 14' through left-hand rotation of tooth 42. As previously described with reference to an insert 14, the extraction of insert 14' can be done while the tooth 42 and notch 12 are continuously engaged, or when the tooth 42 and notch 12 are disengaged and later re-engaged. The process of re-engaging the tooth 42 with notch 12 is the same as that described with reference to insert 14 and, as such, will not be repeated here.

As before, when the tooth 42 is engaged with the notch 12, left-hand rotation of mandrel 30 contracts insert 14' about leading portion 38 of mandrel 30. Once shoulder 45 strikes lead wall 54, insert 14' tightens about leading portion 38, whereby insert 14' is no longer expanded against parent material 18. Continued left-hand driving force of mandrel 30 against insert 14' permits removal of the insert from tapped hole 16. To disengage tooth 42 from notch 12 following removal, slight right-hand rotation (approximately ¼ turn) of mandrel 30 will disengage tooth 42 from notch 12.

Extraction tool 10 allows notch-forming and removal of helical inserts 14, 14' after installation in a tapped hole 16 of parent material 18. Extraction tool 10 provides notch-forming and removal of insert 14, 14' without causing damage to the parent material 18. Accordingly, extraction tool 10 provides a relatively simple and inexpensive way to form a notch and remove an incorrectly installed or damaged insert.

Figure 10:
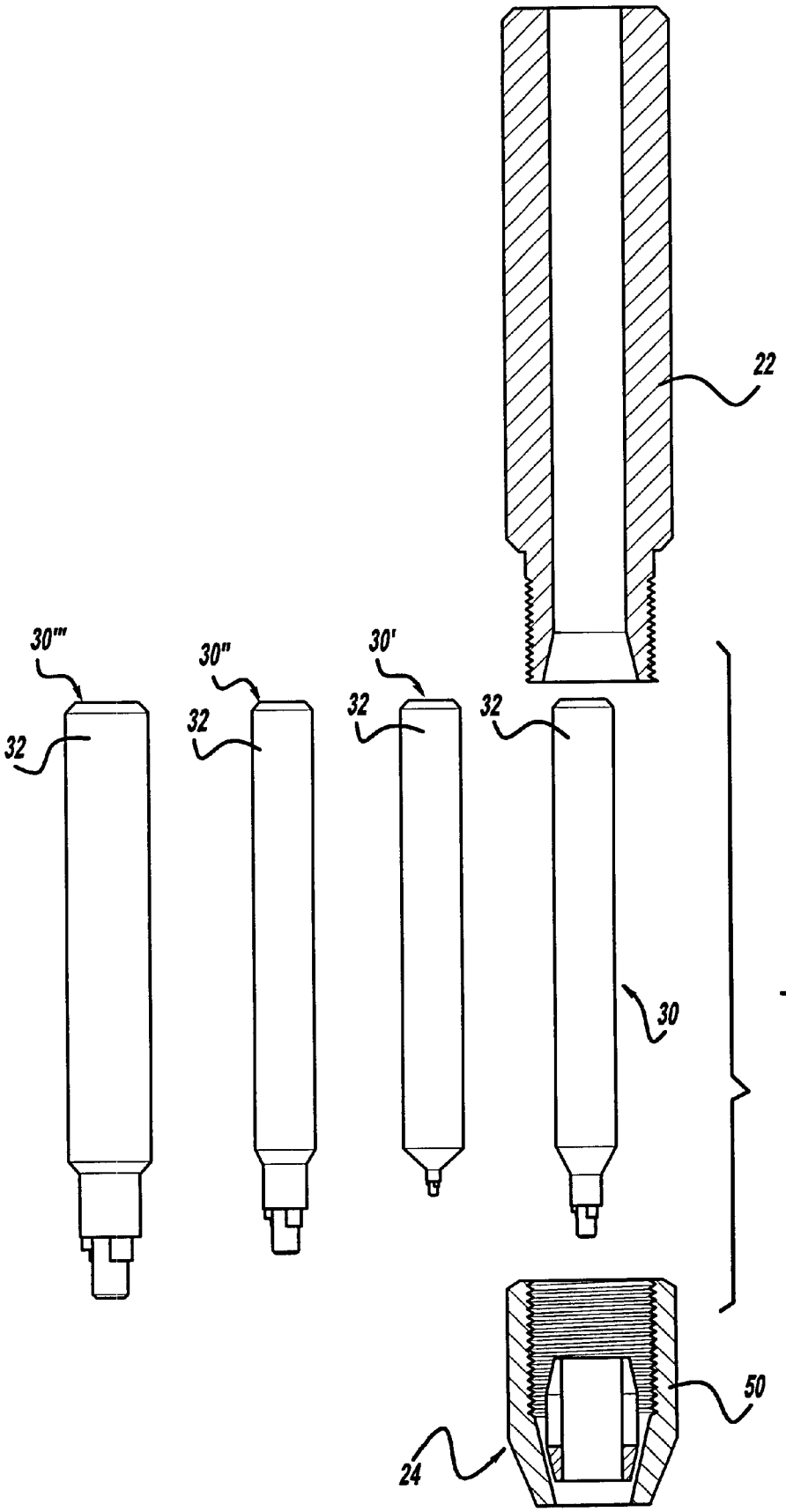
FIG. 10 is a perspective view of a series of notch-forming extraction tools having alternatively sized lead ends.

While the aforementioned extraction tool 10 has been described as including a single mandrel 30, it is preferred to provide a series of mandrels 30 of different sizes corresponding to different-sized inserts 14, 14', as shown in FIG. 10. Thus, a notch-forming extraction tool set 10 includes a single tool body 20 for removing different-sized inserts 14, 14' by simply selecting a mandrel 30, 30', 30", or 30'" corresponding in size to the insert 14, 14' to be removed. Coupler 24 provides simple connection of a selected mandrel 30 to handle 22. Further, mandrel 30 includes first end 32, which is sized for use with various commercial types of handles or other types of mechanical holders. As shown, mandrel body is generally circular in cross-section, but can be made any shape, such as square or hexagonal, for example. Accordingly, mandrel 30 according to the invention can be used independently of body 20 of extraction tool 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A notch-forming extraction tool for removing helically coiled wire inserts having a series of convolutions including a trailing end from a tapped hole in a parent material, said tool comprising:

a mandrel having a first end opposite a second end, said second end including an axial center, a leading portion and a tooth extending laterally from said leading portion, said tooth having a shoulder portion operable to form a notch in said trailing end of said wire insert and contract the series of coils about said leading portion to a diameter less than a diameter of the tapped hole, wherein said wire insert can be extracted from said tapped hole without damaging said parent material; and a handle connected to said first end of said mandrel, said handle operable to drive said mandrel to form the notch and rotate said wire insert when said tooth engages said wire insert.

2. The notch-forming extraction tool of claim 1, further comprising a central longitudinal axis extending through said center of said second end, said central longitudinal axis defined by the intersection of a first longitudinal plane and a second longitudinal plane, wherein said shoulder portion angles from the first longitudinal plane.

3. The notch-forming extraction tool of claim 2, wherein said shoulder portion angles from said first longitudinal plane at approximately 12 degrees.

4. The notch-forming extraction tool of claim 1, wherein said shoulder portion engages said notch so as to apply a camming force to said insert.

5. A notch-forming extraction tool for removing helically coiled wire inserts having a series of convolutions defining a coil diameter and including a trailing end from a tapped hole formed in a parent material and having a hole diameter, said tool comprising:

a mandrel having a first end opposite a second end, said second end including a leading portion and a tooth extending laterally from said leading portion, said leading portion having a mandrel diameter less than the coil diameter and operable to constrict the series of convolutions about the leading portion to a constricted diameter less than the hole diameter; and a handle connected to said first end of said mandrel, said handle allowing rotation of the wire insert when said tooth engages the wire insert, wherein the wire insert can be extracted from the tapped hole without damaging the parent material.

6. The notch-forming extraction tool according to claim 5, wherein said tooth is operable to cut a notch in the trailing end of the wire insert, whereby the series of convolutions can be constricted about the leading portion through engagement of the tooth in the notch and rotation of the handle.

7. The notch-forming extraction tool according to claim 6, wherein said tooth includes a face and a shoulder shaped to cut material of the trailing end and to form the notch, said shoulder further shaped to hook a lead wall defining the notch upon rotation of said handle.

8. The notch-forming extraction tool according to claim 7, A said tooth further including a ramp to facilitate removal of said mandrel from the insert.

9. The notch-forming extraction tool according to claim 8, wherein said second end further includes a void between said ramp and said tooth, said void and said ramp cooperating to position said tooth in the notch of the insert.

10. The notch-forming extraction tool according to claim 7, wherein said face angles outwardly toward said leading edge at a first angle.

11. The notch-forming extraction tool according to claim 10, wherein said first angle is about three degrees.

12. The notch-forming extraction tool according to claim 7, wherein said face angles toward said shoulder at a second angle.

13. The notch-forming extraction tool according to claim 12, wherein said second angle is about three to five degrees.

14. The notch-forming extraction tool according to claim 5, wherein said handle includes a coupler to selectively secure said first end of said mandrel to said handle.

15. The notch-forming extraction tool according to claim 14, wherein said handle includes a bushing to receive said first end of said mandrel and said coupler compresses said bushing about said first end of said mandrel to selectively secure said mandrel to said handle.

16. A mandrel for use with a tool for forming a notch in a helically coiled wire insert having a series of convolutions defining a coil diameter and including a trailing end and for removing the insert from a tapped hole formed in a parent material and including a hole diameter, said mandrel comprising:

a body having a first end opposite a second end, said second end including a leading portion and a tooth extending laterally from said leading portion, said leading portion having a mandrel diameter less than the coil diameter and operable to constrict the series of convolutions about the leading portion to a constricted diameter less than the hole diameter, wherein the wire insert can be extracted from the tapped hole without damaging the parent material.

17. The mandrel according to claim 16, wherein said first end is adapted to couple said mandrel to the tool.

18. The mandrel according to claim 16, wherein said tooth is operable to cut a notch in the trailing end of the wire insert, whereby the series of convolutions can be constricted about the leading portion through engagement of the tooth in the notch and rotation of the handle.

19. The mandrel according to claim 16, wherein said tooth includes a face and a shoulder shaped to cut material of the trailing end and to form the notch, said shoulder further shaped to hook a lead wall defining the notch upon rotation of said handle.

20. The mandrel according to claim 19, said tooth further including a ramp to facilitate removal of said mandrel from the insert.

21. The mandrel according to claim 19, wherein said second end further includes a void between said ramp and said tooth, said void and said ramp cooperating to position said tooth in the notch of the insert.

22. The mandrel according to claim 19, wherein said face angles outwardly toward said leading edge at a first angle.

23. The mandrel according to claim 22, wherein said first angle is about three degrees.

24. The mandrel according to claim 19, wherein said face angles toward said shoulder at a second angle.

25. The mandrel according to claim 24, wherein said second angle is about three to five degrees.

26. The mandrel according to claim 16, wherein said leading portion includes a larger diameter portion and a smaller diameter portion.

27. The mandrel according to claim 26, wherein said larger diameter portion has a circumference larger than said smaller diameter portion.

28. The mandrel according to claim 26, wherein said larger diameter portion includes an inclined surface at one end and said tooth at an opposite end.

29. The mandrel according to claim 26, wherein said smaller diameter portion at least partially defines a void between said inclined surface and said tooth.

30. An extraction tool set for removing helically coiled wire inserts having a coil diameter and a trailing end from a base in a parent material, said tool set comprising:

multiple mandrels, each mandrel of said multiple mandrels having a second end and a first end opposite said second end, each of said second ends differing in diameter and including a leading portion and a tooth extending laterally therefrom; and a body including a handle and a bushing, said bushing selectively receiving said first end of one of said multiple mandrels, being rotatable to contract the insert about said second end of said one of said multiple mandrels to a diameter less than a parent material bore diameter, wherein the wire insert can be extracted from the tapped hole without damaging the parent material, whereby said one of said multiple mandrels complements an inner diameter of the insert and is selected from said multiple mandrels to facilitate removal of the insert.

31. The extraction tool set according to claim 30, wherein said tooth includes a face and a shoulder shaped to cut material of the trailing end and to form the notch, said shoulder further shaped to hook a lead wall defining the notch upon rotation of said handle.

32. The extraction tool set according to claim 30, wherein said tooth includes a face and a shoulder shaped to cut material of the trailing end and to form the notch, said shoulder further shaped to hook a lead wall defining the notch upon rotation of said handle.

33. The extraction tool set according to claim 32, said tooth further including a ramp to facilitate removal of said mandrel from the insert.

34. The extraction tool set according to claim 33, wherein said second end further includes a void between said ramp and said tooth, said void and said ramp cooperating to position said tooth in the notch of the insert.

35. The extraction tool set according to claim 33, wherein said face angles outwardly toward said leading edge at a first angle.

36. The extraction tool set according to claim 35, wherein said first angle is about three degrees.

37. The extraction tool set according to claim 33, wherein said face angles toward said shoulder at a second angle.

38. The extraction tool set according to claim 37, wherein said second angle is about three to five degrees.

39. The extraction tool set according to claim 30, wherein said body includes a coupler to selectively secure said first end of said one of said multiple mandrels to said handle.

40. The extraction tool set according to claim 39 wherein said bushing receives said first end of said one of said multiple mandrels and said coupler compresses said bushing about said first end to selectively secure said one of said multiple mandrels to said handle.

41. The extraction tool set according to claim 30, wherein said leading portion includes a larger diameter portion and a smaller diameter portion.

42. The extraction tool set according to claim 41, wherein said larger diameter portion has a circumference larger than said smaller diameter portion.

43. The extraction tool set according to claim 41, wherein said larger diameter portion includes an inclined surface at one end and said tooth at an opposite end.

44. The extraction tool set according to claim 43, wherein said smaller diameter portion at least partially defines a void between said inclined surface and said tooth.

* * * * *

UNITED STATES PATENT AND TRADEMARK OFFICE

CERTIFICATE OF CORRECTION

PATENT NO. : 6,588,305 B2 
DATED : July 8, 2003
INVENTOR(S) : William Giannakakos et al.

It is certified that error appears in the above-identified patent and that said Letters Patent is hereby corrected as shown below:

Column 6,
Line 41, after "said" (first occurrence) insert -- axial --.

Column 7,
Line 12, delete "A".

Signed and Sealed this

Fourteenth Day of October, 2003

JAMES E. ROGAN
*Director of the United States Patent and Trademark Office*